US008925770B1

(12) United States Patent
Garcia

(10) Patent No.: US 8,925,770 B1
(45) Date of Patent: Jan. 6, 2015

(54) HANGER/CLIP SYSTEM

(71) Applicant: Roberto Garcia Garcia, Tampa, FL (US)

(72) Inventor: Roberto Garcia Garcia, Tampa, FL (US)

( * ) Notice: Subject to any disclaimer, the term of this patent is extended or adjusted under 35 U.S.C. 154(b) by 0 days.

(21) Appl. No.: 14/030,072

(22) Filed: Sep. 18, 2013

(51) Int. Cl.
*A47G 25/48* (2006.01)
*A47G 25/14* (2006.01)

(52) U.S. Cl.
CPC ..... *A47G 25/48* (2013.01)
USPC ..... 223/91

(58) Field of Classification Search
CPC ..... A47G 25/14; A47G 25/16; A47G 25/18; A47G 25/20; A47G 25/30; A47G 25/48; A47G 25/50; A41D 27/22
USPC ..... 223/85–97; 211/112, 113; D6/326
See application file for complete search history.

(56) References Cited

U.S. PATENT DOCUMENTS

| | | | | | |
|---|---|---|---|---|---|
| 1,799,717 | A * | 4/1931 | Wilson | 24/490 |
| 2,400,058 | A * | 5/1946 | Concannon | 223/96 |
| 2,522,013 | A * | 9/1950 | Anderson | 223/91 |
| 2,594,228 | A * | 4/1952 | Smith | 40/322 |
| 3,378,180 | A * | 4/1968 | Singer | 223/87 |
| 3,741,449 | A * | 6/1973 | MacKenzie | 223/91 |
| 3,967,346 | A * | 7/1976 | Young, Jr. | 211/89.01 |
| 5,029,739 | A * | 7/1991 | Blanchard et al. | 223/88 |
| 5,515,978 | A * | 5/1996 | Moran | 211/30 |
| 5,515,981 | A * | 5/1996 | Gregory et al. | 211/113 |
| D530,928 | S * | 10/2006 | Bowers | D6/326 |
| 7,481,340 | B2 * | 1/2009 | Murphy | 223/85 |
| 7,641,061 | B1 * | 1/2010 | Cuzzocrea | 211/113 |
| 8,267,287 | B2 * | 9/2012 | Gouldson | 223/88 |
| 2005/0178806 | A1 * | 8/2005 | Sebel | 223/92 |
| 2007/0194063 | A1 * | 8/2007 | Wu | 223/85 |

* cited by examiner

*Primary Examiner* — Ismael Izaguirre

(57) ABSTRACT

A hanger releasably supports a shirt. The hanger has a middle support and laterally extending shoulder supports. A hook is in an inverted J-shaped configuration. The hook is coupled to and extends upwardly from the middle support of the hanger. A clip has an interior segment and an exterior segment. The interior segment has an upper part coupled to the middle support. The interior segment has a pivot line and a convex lower part beneath the pivot line. The interior segment has a lower edge beneath the convex lower part. The exterior segment has an upper edge and a lower edge. The lower edges of the interior and exterior segments form a semi-cylindrical finger. In this manner pressing the upper edge of the exterior segment will pivot the finger about the mid-line away from the middle support.

7 Claims, 5 Drawing Sheets

HANGER/CLIP SYSTEM

BACKGROUND OF THE INVENTION

Field of the Invention

The present invention relates to a hanger/clip system and more particularly pertains to supporting a clean shirt in a wrinkle-free orientation and for retaining such shirt in such wrinkle free orientation until removed by a user, the supporting and retaining and removing being done in a safe, convenient and economical manner.

SUMMARY OF THE INVENTION

In view of the foregoing disadvantages inherent in the known types of xother now present in the prior art, the present invention provides an improved hanger/clip system. As such, the general purpose of the present invention, which will be described subsequently in greater detail, is to provide a new and improved hanger/clip system and method which has all the advantages of the prior art and none of the disadvantages.

To attain this, the present invention essentially comprises a hanger. The hanger releasably supports a shirt. The hanger has a middle support and laterally extending shoulder supports. A hook is in an inverted J-shaped configuration. The hook is coupled to and extends upwardly from the middle support of the hanger. A clip has an interior segment and an exterior segment. The interior segment has an upper part coupled to the middle support. The interior segment has a pivot line and a convex lower part beneath the pivot line. The interior segment has a lower edge beneath the convex lower part. The exterior segment has an upper edge and a lower edge. The lower edges of the interior and exterior segments form a semi-cylindrical finger. In this manner pressing the upper edge of the exterior segment will pivot the finger about the mid-line away from the middle support.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hanger/clip system which has all of the advantages of the prior art hanger systems of known designs and configurations and none of the disadvantages.

It is another object of the present invention to provide a new and improved hanger/clip system which may be easily and efficiently manufactured and marketed.

It is further object of the present invention to provide a new and improved hanger/clip system which is of durable and reliable constructions.

An even further object of the present invention is to provide a new and improved hanger/clip system which is susceptible of a low cost of manufacture with regard to both materials and labor, and which accordingly is then susceptible of low prices of sale to the consuming public, thereby making such hanger/clip system economically available to the buying public.

Lastly, another object of the present invention is to provide a hanger/clip system for supporting a clean shirt in a wrinkle-free orientation and for retaining such shirt in such wrinkle free orientation until removed by a user, the supporting and retaining and removing being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
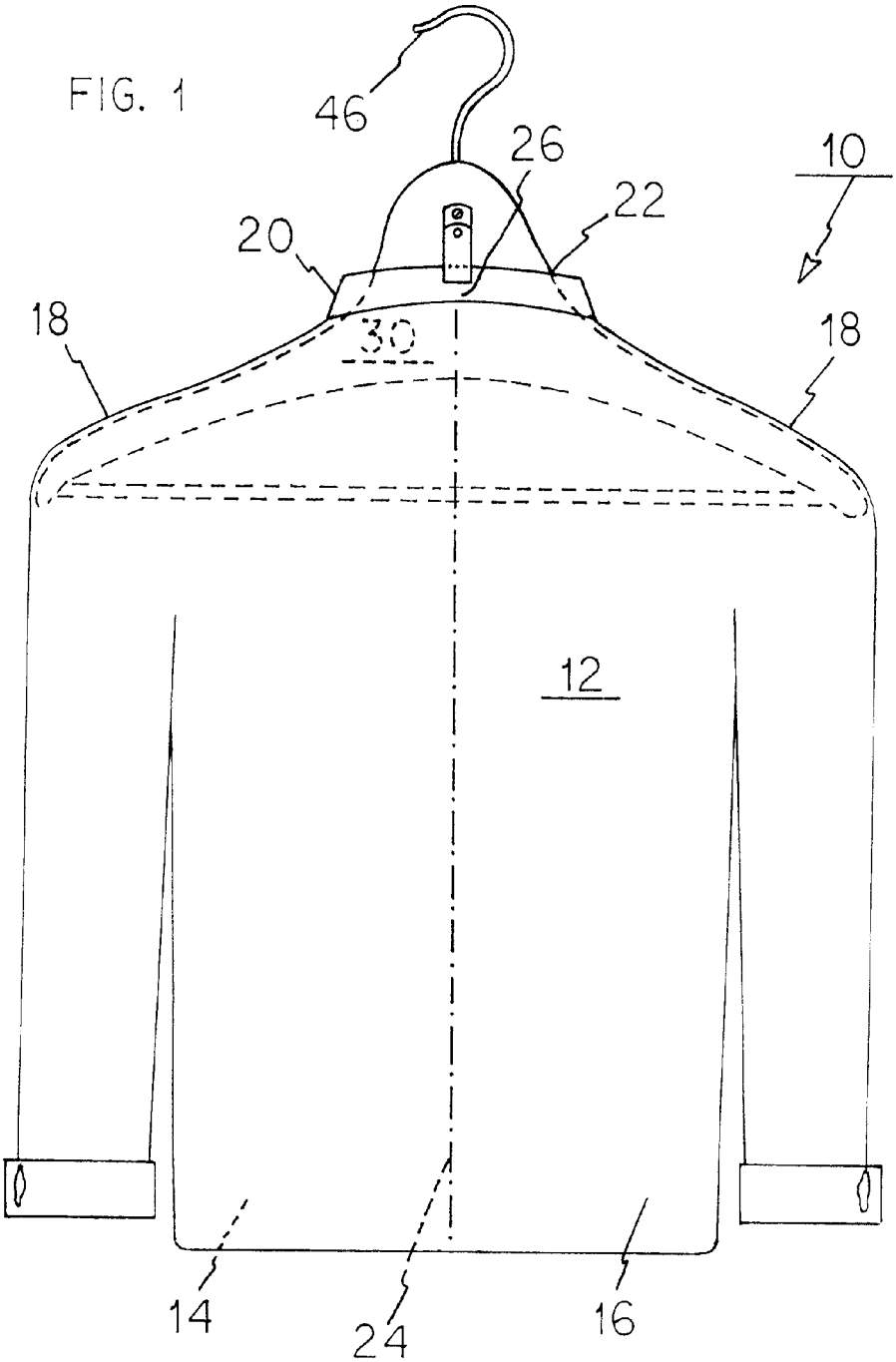
FIG. 1 is a rear elevational view of a hanger/clip system and a shirt supported thereby, the system being constructed in accordance with the principles of the present invention.
Figure 2:
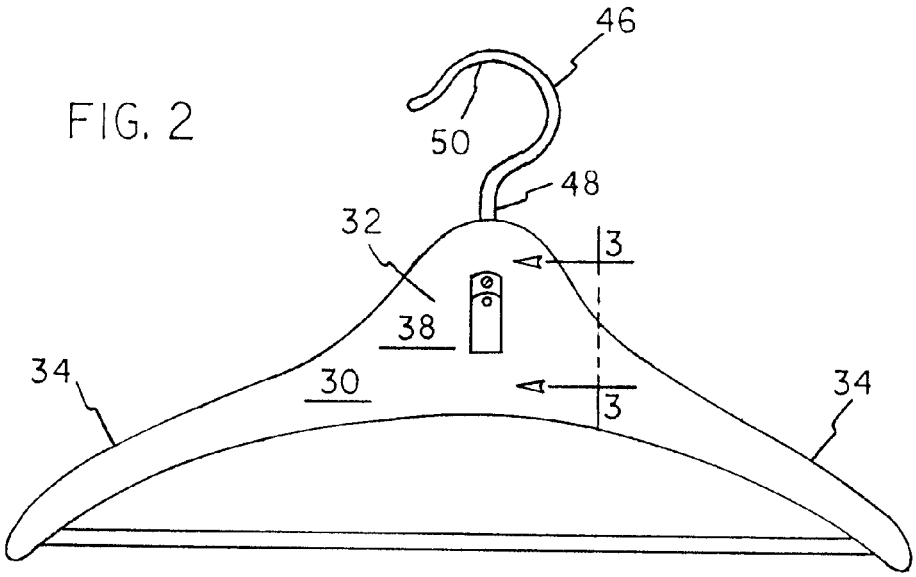
FIG. 2 is a rear elevational view similar to FIG. 1 but with the shirt removed.
Figure 3:
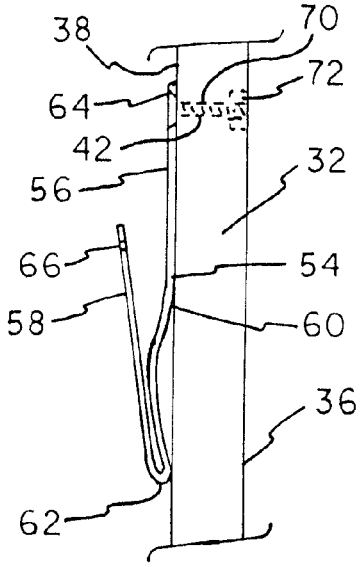
FIG. 3 is a cross sectional view taken along line 3-3 of FIG. 2.

With reference now to the drawings, and in particular to FIG. 1 thereof, the preferred embodiment of the new and improved hanger/clip system embodying the principles and concepts of the present invention and generally designated by the reference numeral 10 will be described.

The present invention, the hanger/clip system 10 is comprised of a plurality of components. Such components in their broadest context include a hanger, a hook, and a clip. Such components are individually configured and correlated with respect to each other so as to attain the desired objective.

First provided is a shirt 12. The shirt has a front 14. The shirt has a back 16. The shirt has laterally extending shoulders 18. The shirt also has a collar 20. The collar has a neck opening 22. The neck opening extends through the collar. The shirt also includes a chest opening 24. The chest opening extends vertically down the front from the collar. The shirt has an upper central region 26. The upper central region is provided on the back of the shirt on the collar. The shirt is fabricated of a flexible fabric.

A hanger 30 is provided. The hanger releasably supports the shirt. The hanger has a middle support 32. The hanger has laterally extending shoulder supports 34. The shoulder supports extend downwardly and outwardly from the middle support. The shoulder supports terminate at opposed ends. The shoulder supports and the middle support have a vertical planar front surface 36. The shoulder supports and the middle support also have a vertical planar rear surface 38. The shirt is supported on the hanger during use. The middle support of the hanger extends through the neck opening of the shirt. The shoulder supports of the hanger extend through and support the shoulders of the shirt. The upper central region of the shirt overlies the rear surface of the middle support of the hanger. The hanger also has a cylindrical pants support rod 40. The cylindrical pants support rod has opposed ends. The cylindrical pants support rod is supported by the opposed ends of the shoulder supports. The middle support has a hole 42. The hole extends through the middle support. The hole has a counter sunk end at the front surface. The hanger is fabricated of wood.

Provided next is a hook 46. The hook is in an inverted J-shaped configuration. The hook has a linear lower extent 48. The linear lower extent extending vertically into the middle support of the hanger. The hook has an arcuate upper extent 50. The arcuate upper extent is adapted to be removably supported on a closet rod. The hook is fabricated of a rigid wire.

Further provided is a clip 54. The clip has an interior segment 56. The clip has an exterior segment 58. The interior segment is in a generally rectangular configuration. The interior segment has an upper edge, a lower edge and a mid-line 60. The mid-line separates the interior segment into an upper part and a lower part. The upper part is planar in facing contact with the rear surface of the middle support of the hanger. The lower part is convex. The lower part has an upper edge. The lower part has a lower edge. The exterior segment is planar with an upper edge and a lower edge. The lower edges of the interior and exterior segments form a semi-cylindrical finger 62. The interior segment has a large aperture 64. The large aperture is provided adjacent to the upper edge of the interior segment. The upper edge of the exterior segment is located at an elevation beneath the large aperture. The exterior segment has a small aperture 66. The small aperture is adjacent to the upper edge of the exterior segment. In this manner pressing the upper edge of the exterior segment will pivot the finger about the mid-line away from the middle support and a supported shirt. Further in this manner the release of the upper edge of the exterior segment will resiliently pivot the finger toward the upper central region of a supported shirt.

Provided last is a bolt 70. The bolt extends through the large aperture of the interior segment and the hole in the hanger. In this manner the clip is secured to the hanger. A nut 72 is provided. The nut is provided in the counter-sunk end. In this manner the bolt is secured in the hole and the clip to the hanger.

Figure 4:
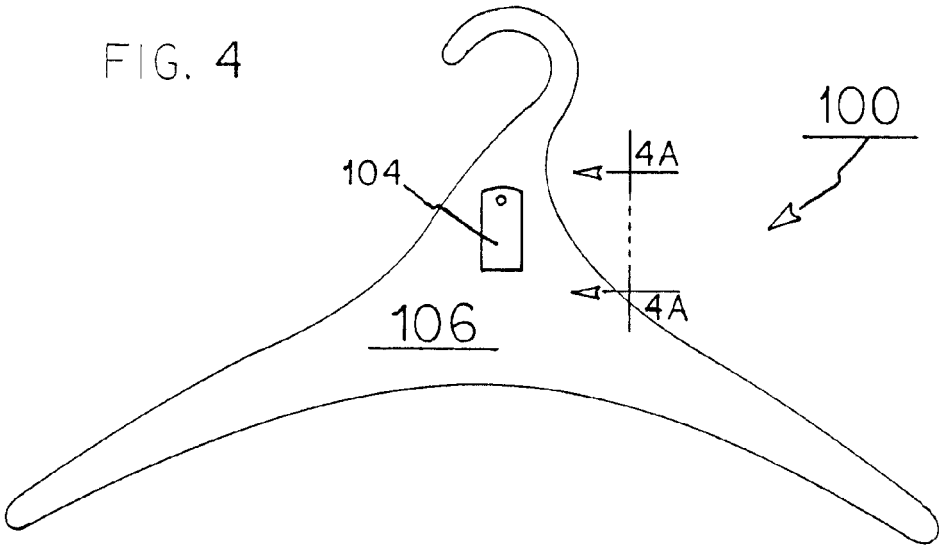
FIG. 4 is a rear elevational view similar to FIG. 2 but illustrating an alternate embodiment of the invention.
Figure 4A:
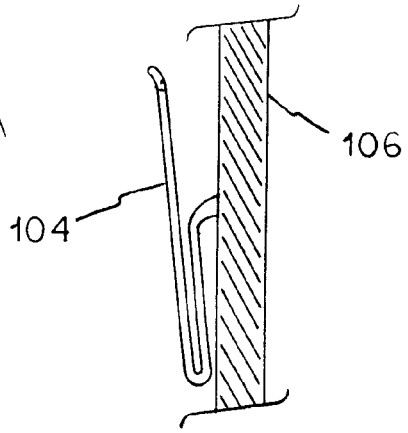
FIG. 4A is a cross sectional view taken along line 4A-4A of FIG. 4.

The first alternate embodiment 100 of the present invention has a clip 104. A hanger 106 is also provided. The clip and hanger are integrally molded of plastic. Note FIGS. 4 and 4A.

Figure 5:
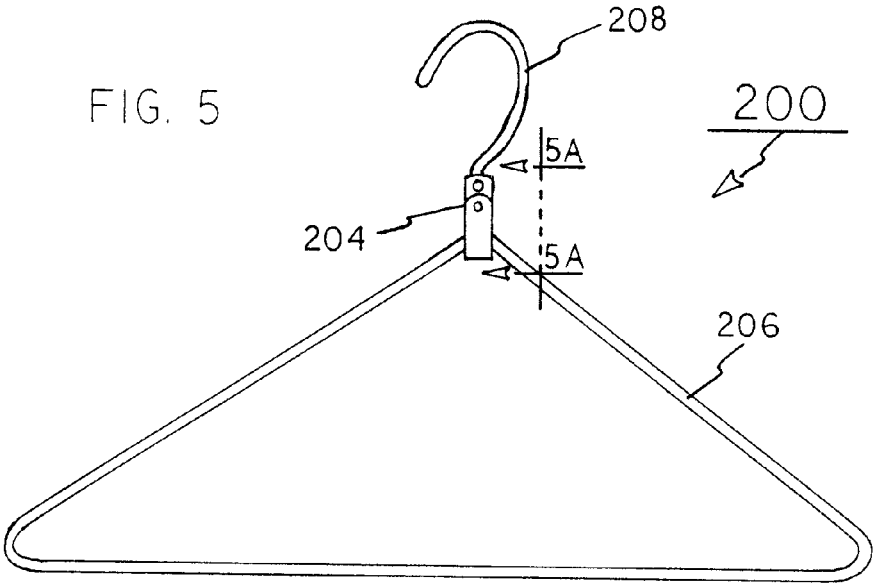
FIG. 5 is a rear elevational view similar to FIGS. 2 and 4 but illustrating another alternate embodiment of thr invention.
Figure 5A:
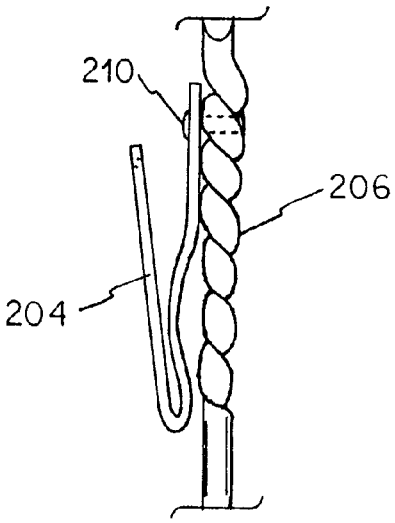
FIG. 5A is a cross sectional view taken along line 5A-5A of FIG. 5.

The next alternate embodiment 200 of the present invention includes a clip 204. A hanger 206 is provided. A hook 208 is also provided. The clip and hanger are constructed of wire. The system includes a fastener 210. The fastener couples the clip to the hanger. Note FIGS. 5 and 5A.

Figure 6:
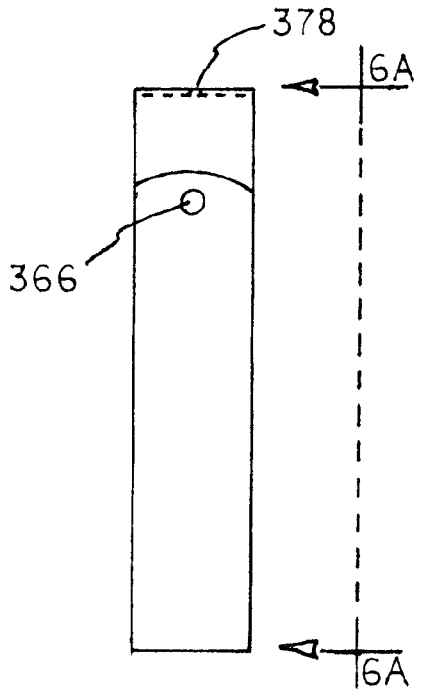
FIG. 6 is a front elevational view of a clip illustrating a final alternate embodiment of the invention.
Figure 6A:
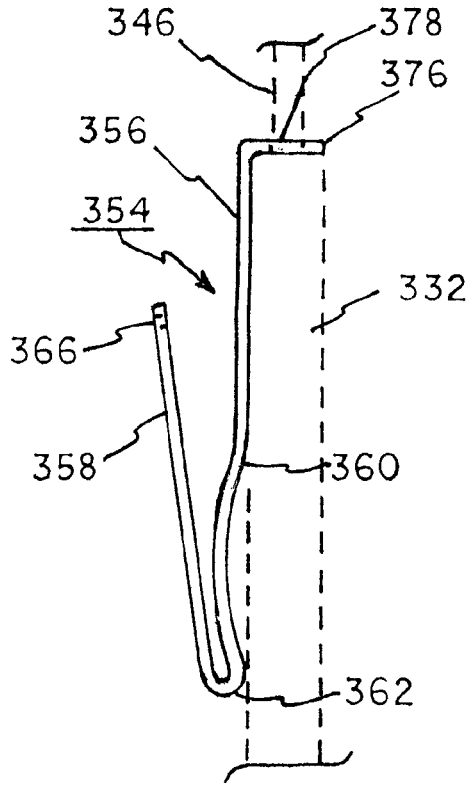
FIG. 6A is a cross sectional view taken along line 6A-6A of FIG. 6.

In a final alternate embodiment, the invention may also be considered as the clip alone adapted for use with a hanger. Note FIGS. 6 and 6A. A clip 354 is adapted to be removably coupled to a hanger 332 of the type having a hook 346.

The clip has an interior segment 356. The clip has an exterior segment 358. The clip also has an in-turned tab 376.

The interior segment has a vertically extending upper part. The upper part is positionable in contact with the hanger. The interior segment has a pivot line 360. The interior segment has a convex lower part beneath the pivot line. The interior segment has an upper edge and a lower edge. The lower edge is provided beneath the convex lower part.

The exterior segment has a lower edge and an upper edge with a small aperture 366. The lower edges of the interior and exterior segments form a semi-cylindrical finger 362. The semi-cylindrical finger is normally in contact with the hanger.

The in-turned tab is formed from a bend at the upper edge of the interior segment. The tab has a horizontal aperture 378. The horizontal aperture receives the hook of the hanger. In this manner pressing the upper edge of the exterior segment will pivot the finger about the mid-line away from the hanger and a shirt supported on the hanger. Further in this manner release of the upper edge of the exterior segment will resiliently pivot the finger toward a shirt to be supported on the hanger.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A single clip (354) adapted to be removably coupled to a single hanger (332), the hanger being of the type having a hook (346) and shoulder supports and a middle support between the hook and the shoulder supports, the clip including:

an interior segment (356) and an exterior segment (358) and an in-turned tab (376);

the interior segment having a vertically extending upper part positionable in contact with the hanger, the interior segment having a pivot line (360) and a convex lower part beneath the pivot line, the interior segment having an upper edge and a lower edge, the lower edge being beneath the convex lower part;

the exterior segment having a lower edge and an upper edge with a small aperture (366) there adjacent, the lower edges of the interior and exterior segments forming a semi-cylindrical finger (362) normally in contact with the middle support of the hanger with a shirt collar between and in contact with the clip and the middle support of the hanger; and the in-turned tab formed from a bend at the upper edge of the interior segment, the tab having an horizontal aperture (378) there through receiving the hook of the hanger above the shoulder supports whereby pressing the upper edge of the exterior segment will pivot the finger about the pivot line away from the hanger and a shirt supported on the hanger and whereby release of the upper edge of the exterior segment will resiliently pivot the finger toward a shirt to be supported on the hanger, the clip being of a one piece construction fabricated of a flexible material.

2. A hanger/clip system comprising:

a single hanger for releasably supporting a shirt of the type having a collar, the hanger formed with a middle support and laterally extending shoulder supports, a middle support on the hanger being intermediate the hook and the shoulder supports;

a hook in an inverted J-shaped configuration coupled to and extending upwardly from the middle support of the hanger; and a single clip having an interior segment and an exterior segment, the interior segment having an upper part coupled to the middle support above the shoulder supports, the interior segment having a pivot line and a convex lower part beneath the pivot line, the interior segment having a lower edge beneath the convex lower part, the exterior segment having an upper edge and a lower edge, the lower edges of the interior and exterior segments forming a semi-cylindrical finger whereby pressing the upper edge of the exterior segment will pivot the finger about the pivot line away from the middle support, the collar of the shirt being between and in contact with the clip and the middle support, the clip being of a one piece construction fabricated of a flexible material.

3. The system as set forth in claim 2 wherein the hanger is fabricated of a rigid material chosen from the class of rigid materials including wood, plastic and wire.

4. The system as set forth in claim 2 wherein the clip and the hanger are separately fabricated and then coupled together.

5. The system (100) as set forth in claim 2 wherein the clip (104) and the hanger (106) are integrally molded of plastic.

6. The system (200) as set forth in claim 2 wherein the clip (204) and the hanger (206) and hook (208) are constructed of wire, the system including a fastener (210) coupling the clip to the hanger.

7. A hanger/clip system (10) for supporting a clean shirt (12) in a wrinkle-free orientation and for retaining such shirt in such wrinkle-free orientation until removed by a user, the supporting and retaining and removing being done in a safe, convenient and economical manner, the hanger/clip system including, in combination:

the shirt (12) having a front (14) and a back (16) and laterally extending shoulders (18), the shirt also having a collar (20) with a neck opening (22) extending through the collar, the shirt also including a chest opening (24) extending vertically down the front from the collar, the shirt having an upper central region (26) on the back of the shirt on the collar, the shirt being fabricated of a flexible fabric;

a hanger (30) for releasably supporting the shirt, the hanger formed with a middle support (32) and laterally extending shoulder supports (34), the shoulder supports extending downwardly and outwardly from the middle support, the shoulder supports terminating at opposed ends, the shoulder supports and the middle support having a vertical planar front surface 36 and a vertical planar rear surface (38), the shirt being supported on the hanger during use with the middle support of the hanger extending through the neck opening of the shirt and with the shoulder supports of the hanger extending through and supporting the shoulders of the shirt and with the upper central region of the shirt overlying the rear surface of the middle support of the hanger, the hanger also formed with a cylindrical pants support rod (40) with opposed ends supported by the opposed ends of the shoulder supports, a hole (42) extending through the middle support, the hole having a counter sunk end at the front surface, the hanger being fabricated of wood;

a hook (46) in an inverted J-shaped configuration, the hook having a linear lower extent (48) extending vertically into the middle support of the hanger, the hook having an arcuate upper extent (50) adapted to be removably supported on a closet rod, the hook being fabricated of a rigid wire;

a clip (54) having an interior segment (56) and an exterior segment (58), the interior segment having a generally rectangular configuration with an upper edge and a lower edge and a pivot line (60), the pivot line separating the interior segment into an upper part and a lower part, the upper part being planar in facing contact with the rear surface of the middle support of the hanger, the lower part being convex with an upper edge and a lower edge, the exterior segment being planar with an upper edge and a lower edge, the lower edges of the interior and exterior segments forming a semi-cylindrical finger (62), the interior segment having a large aperture (64) adjacent to the upper edge of the interior segment, the upper edge of the exterior segment being located at an elevation beneath the large aperture, the exterior segment having a small aperture (66) adjacent to the upper edge of the exterior segment whereby pressing the upper edge of the exterior segment will pivot the finger about the pivot line away from the middle support and a supported shirt and whereby release of the upper edge of the exterior segment will resiliently pivot the finger toward the upper central region of a supported shirt; and a bolt (70) extending through the large aperture of the interior segment and the hole in the hanger for coupling the clip to the hanger, a nut (72) in the counter-sunk end for removably securing the bolt in the hole and the clip to the hanger.

* * * * *